US005638903A

United States Patent [19]

Kent

[11] Patent Number: 5,638,903

[45] Date of Patent: Jun. 17, 1997

[54] ADJUSTABLE MANDREL HANGER SYSTEM

[75] Inventor: Peter M. Kent, Warthill, Scotland

[73] Assignee: ABB Vetco Gray Inc., Houston, Tex.

[21] Appl. No.: 419,347

[22] Filed: Apr. 10, 1995

[51] Int. Cl.[6] ..... E21B 43/10

[52] U.S. Cl. ..... 166/348; 166/381; 166/208

[58] Field of Search ..... 166/348, 382, 166/212, 381, 125, 208, 98; 285/145

[56] References Cited

U.S. PATENT DOCUMENTS

| | | | |
|---|---|---|---|
| 4,154,298 | 5/1979 | Gano | 166/348 X |
| 4,456,070 | 6/1984 | Watkins | 166/345 |
| 4,540,053 | 9/1985 | Baugh et al. | 166/348 |
| 4,615,544 | 10/1986 | Baugh | 166/348 X |
| 4,909,546 | 3/1990 | Nobileau . | |
| 4,919,454 | 4/1990 | Caulfield et al. | 166/382 X |
| 4,949,786 | 8/1990 | Eckert et al. . | |
| 4,995,464 | 2/1991 | Watkins et al. . | |
| 5,002,131 | 3/1991 | Cromar et al. . | |
| 5,240,076 | 8/1993 | Cromar et al. . | |
| 5,255,746 | 10/1993 | Bridges . | |
| 5,311,947 | 5/1994 | Kent et al. . | |

OTHER PUBLICATIONS

U.S. application Ser. No. 08/285,577, Filed Aug. 3, 1994.

*Primary Examiner*—Frank Tsay
*Attorney, Agent, or Firm*—James E. Bradley

[57] ABSTRACT

An adjustable mandrel hanger system is employed for maintaining tension in a string of casing extending between a subsea wellhead assembly and a surface wellhead housing. The system has a mandrel which connects into the string. A locking member locks to the exterior of the mandrel. The locking member has a cocked position which allows both upward and downward movement of the mandrel relative to the locking member. The locking member has a weight supporting position which will prevent downward movement of the mandrel but allows upward movement of the mandrel relative to the locking member. The locking member lands on an internal shoulder in the surface wellhead housing while the string is being lowered into the well. The running tool has an actuating member which will hold the locking member in the cocked position and in engagement with the internal shoulder while the running tool secures the lower end of the casing string into engagement with the subsea wellhead assembly. The actuating member will move upward relative to the locking member to allow the locking member to move to the weight supporting position, so that a release of the pull by the running tool will cause the locking member to support the string in tension.

24 Claims, 7 Drawing Sheets

ADJUSTABLE MANDREL HANGER SYSTEM

BACKGROUND OF THE INVENTION

1. Field of the Invention

This invention relates in general to a system for tensioning a string of casing extending between a subsea wellhead and a surface wellhead located on offshore platform, and in particular to a system utilizing an adjustable mandrel.

2. Description of the Prior Art

In certain types of offshore drilling, a string of casing will be connected between a subsea wellhead assembly at the sea floor and a surface wellhead at a platform located at the surface. For example, one technique involves drilling subsea wells with a floating drilling rig and leaving the wells cased but not completed for production. Later a production platform is installed over the subsea wellhead assemblies for completing the wells with surface wellheads at the platform. A tieback string of casing will be lowered from the platform and latched into the subsea assembly. The operator applies tension to the tieback string and adjusts a load shoulder at the surface wellhead for maintaining the tieback string in tension.

A number of different systems have been used and proposed in the past. Some of these systems employ a locking member which will ratchet on a mandrel in one direction and support weight in the other direction to maintain the string in tension. While these systems are workable, improvements to reduce cost and facilitate installation are desirable.

SUMMARY OF THE INVENTION

In this invention, a locking member, preferably a combination load ring and ratchet ring, is mounted to a mandrel. The locking member has a cocked position which allows upward and downward movement of the mandrel relative to the locking member. The locking member also has a weight supporting position which prevents downward movement but allows upward of the mandrel relative to the locking member. The locking member has an external shoulder which will land on an internal shoulder in the surface wellhead.

A running tool runs the tieback string through the surface wellhead and lands the external shoulder of the locking member on the internal shoulder. The running tool then lowers the string relative to the locking member and secures the lower end of the string into the subsea wellhead assembly. During this procedure, the locking member will be held in the cocked position by an actuating member carried by the running tool. Subsequently, the actuating member will be moved upward relative to the locking member, allowing the locking member to move to the weight supporting position. A release of the pull by the running tool will cause the locking member to support the string in tension.

In one embodiment, the actuating member includes a hydraulic piston which holds the locking member in engagement with the shoulder while the string is lowered relative to the locking member and while tension is pulled on the string. Then, the piston is stroked upward to disengage from the locking member. The upward movement shifts the locking member from the cocked position to the weight supporting position.

In another embodiment, a latch ring causes the actuating member to move upward relative to the locking member once the operator begins to pull tension on the casing. In that embodiment, a retainer ring on the locking member engages a groove in the surface wellhead housing to maintain the locking member in contact with the internal shoulder. The locking member shifts to the weight supporting position once the actuating member disengages from it.

DETAILED DESCRIPTION OF THE INVENTION

Figure 1A:
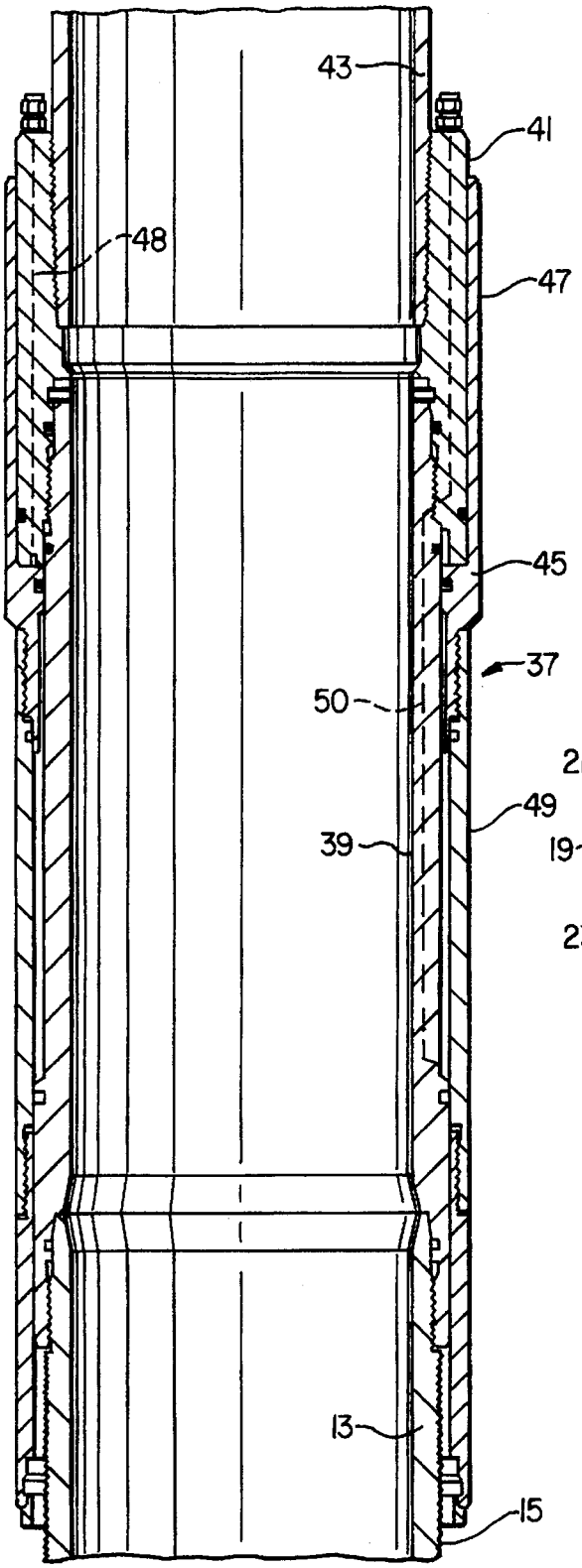
FIGS. 1A and 1B comprise a sectional view of an adjustable mandrel hanger system constructed in accordance with this invention and shown prior to insertion into a surface wellhead.
Figure 1B:
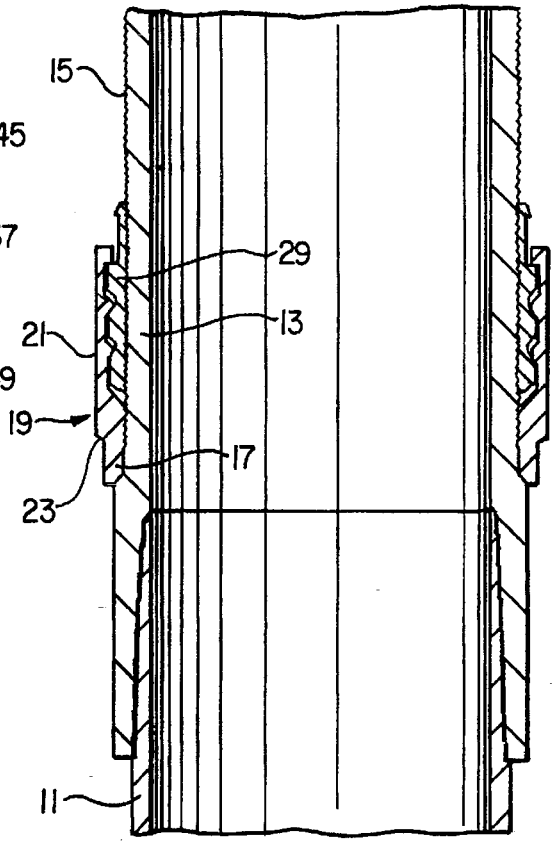

Referring to FIGS. 1A and 1B, a tieback string of casing 11 secures to the lower end of a mandrel 13. Mandrel 13 is a tubular member having a plurality of grooves or wickers 15 on its exterior. Wickers 15 comprise small parallel triangular grooves extending circumferentially around mandrel 13. Mandrel 13 has an upward facing exterior shoulder 17 on which rests a locking member 19.

Figure 3:
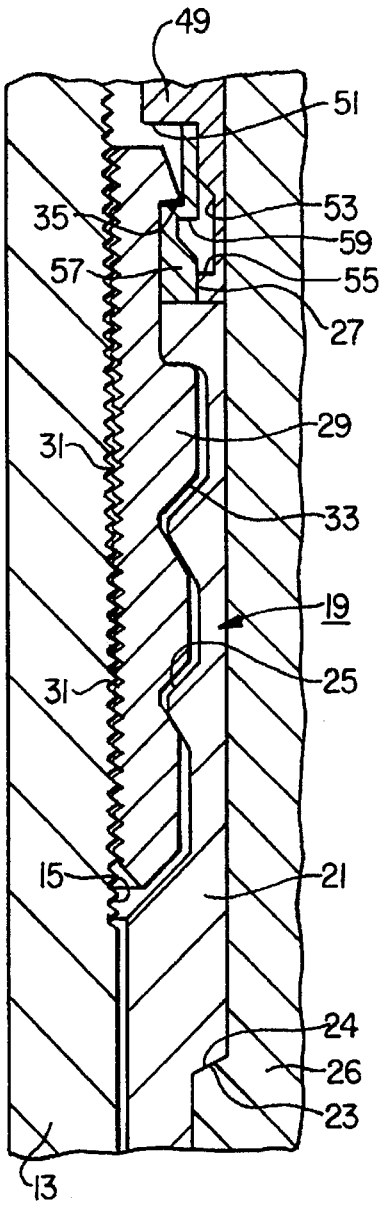
FIG. 3 is a partial enlarged sectional view of a portion of the locking member of the adjustable mandrel hanger system of FIGS. 1A and 1B.

Locking member 19 includes an outer solid load ring 21 which has an external shoulder 23 which will land on an internal shoulder 24 of a surface wellhead housing 26 (FIG. 3). Surface wellhead housing 26 will be located on an offshore platform at a well deck approximately 90 feet below a rig floor. A blowout preventer stack (not shown) extends from surface wellhead housing 26 upward to the rig floor. Load ring 21 has internal conical load flanks 25 and an upper rim 27.

Locking member 19 also includes a ratchet ring 29, which is carried within load ring 21. Ratchet ring 29 is an inwardly biased collet member having serpentine cuts (not shown) in its sidewall which enables ratchet ring 29 to radially expand and contract. Ratchet ring 29 has wickers 31 in its interior which mate with wickers 15 on mandrel 13. Ratchet ring 29 has conical load flanks 33 on its exterior which mate with load flanks 25 of load ring 21. Ratchet ring 29 has on its upper end a lip 35 which provides a downward facing shoulder.

Referring again to FIG. 1A, a running tool 37 is employed to lower mandrel 13 and tieback casing 11 through the blow-out preventer stack (not shown). Casing 11 passes through surface wellhead housing 26 (FIG. 2B), and load ring 21 will land on internal shoulder 24 at wellhead housing 26. Running tool 37 has a tubular body 39 and an adapter 41 on its upper end. Adapter 41 secures to a running string 43 which extends up to elevators (not shown) at the rig floor for lowering the assembly into the well and applying tension.

Figure 2A:
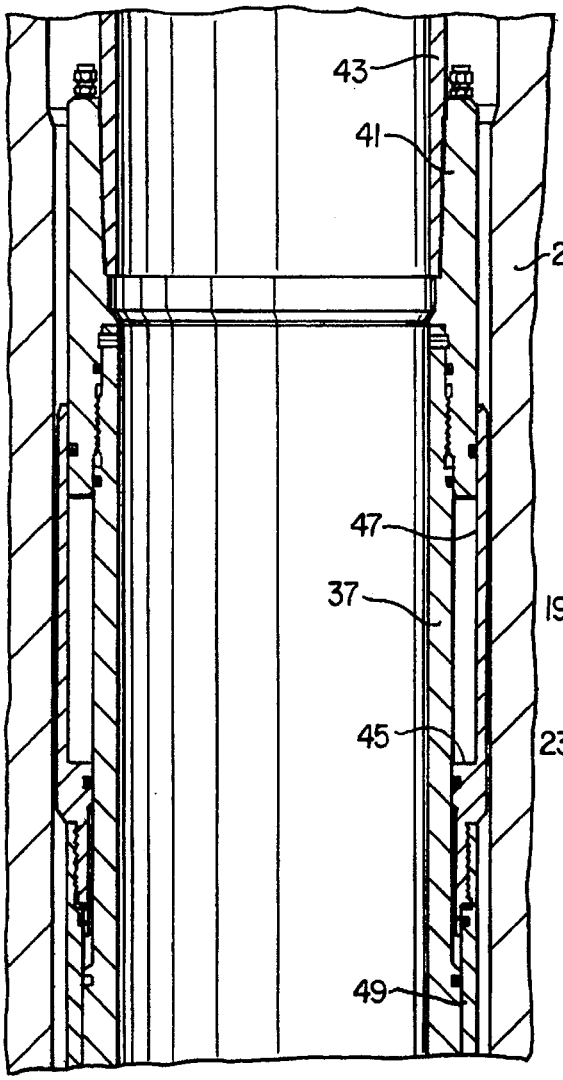
FIGS. 2A and 2B comprise a sectional view of the adjustable mandrel hanger system of FIGS. 1A and 1B, but show the system landed in a surface wellhead housing.
Figure 2B:
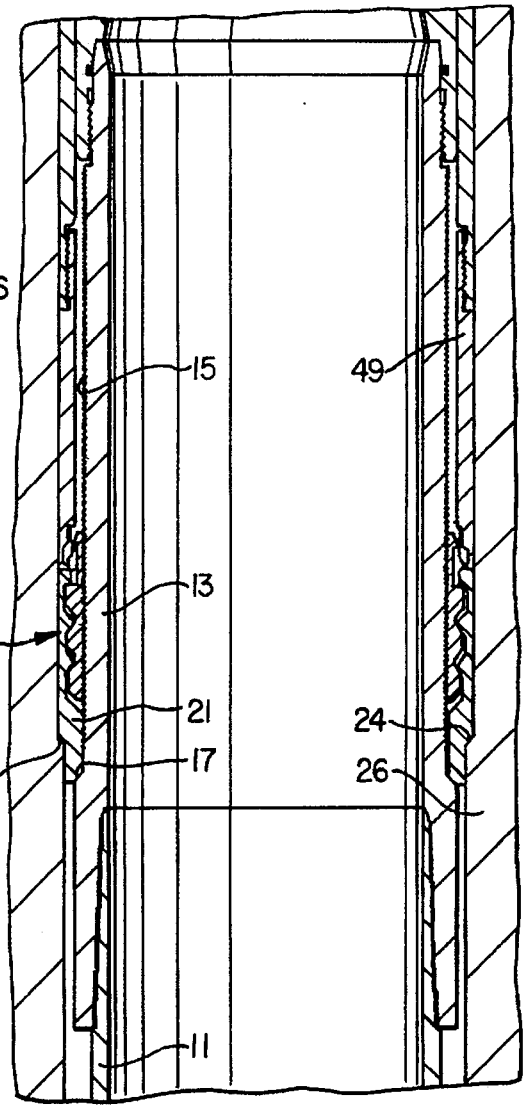

A piston 45 forms a portion of running tool 37. Piston 45 has an upward extending sleeve 47 which sealingly engages the exterior of adapter 41. Piston 45 is secured by threads to the upper end of an actuator sleeve 49. A plurality of downstroke hydraulic passages 48 extend through adapter 41 to a chamber at the upper side of piston 45 for supplying hydraulic fluid through a line (not shown) extending to the rig floor. An upstroke hydraulic passage 50 extends through adapter 41 and body 39 to a chamber on the lower side of piston 45 for supplying hydraulic fluid through another line (not shown). Supplying hydraulic fluid pressure through downstroke passage 48 strokes piston 45 and actuator sleeve 49 downward relative to body 39, as shown in FIG. 2A. Supplying hydraulic fluid pressure through upstroke passage 50 strokes piston 45 and actuator sleeve 49 upward relative to body 39.

Actuator sleeve 49 has a retainer means on its lower end, which is shown more clearly in FIG. 3. The retainer means includes a downward facing shoulder 51 on the lower end of actuator sleeve 49. A recess 53 is located below shoulder 51. A radially inward protruding foot 55 is formed at the extreme lower end of actuator sleeve 49. An outward biased split retainer ring 57 is carried by actuator sleeve 49 below shoulder 51. Retainer ring 57 has a hooked-shaped recess 59 on its outer diameter that is located opposite recess 53 when the retainer means is in the cocked position shown in FIG. 3. In the cocked position, a lower portion of retainer ring 57 contacts rim 27 and an upper portion contacts lip 35, preventing the load flanks 25, 33 from engaging each other to support weight. In the cocked position, mandrel 13 is free to move both up and down relative to ratchet ring 29. Even though the wickers 15, 31 will touch each other, ratcheting will occur because clearances exist between the load flanks 25, 33.

Figure 6A:
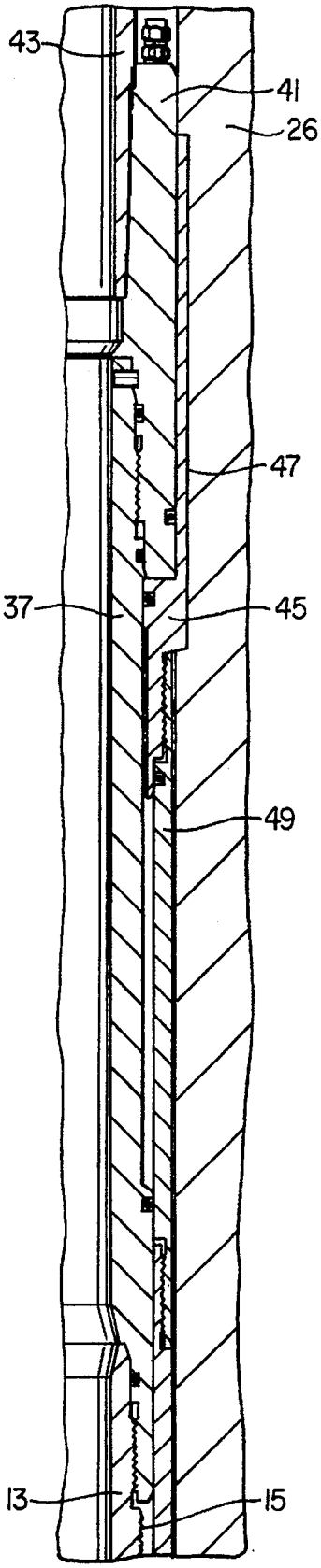
FIGS. 6A and 6B comprise a quarter sectional view of the adjustable mandrel hanger system of FIG. 1 and show the actuating member of the running tool releasing from the locking member, causing the locking member to move from the cocked position to the weight supporting position.
Figure 6B:
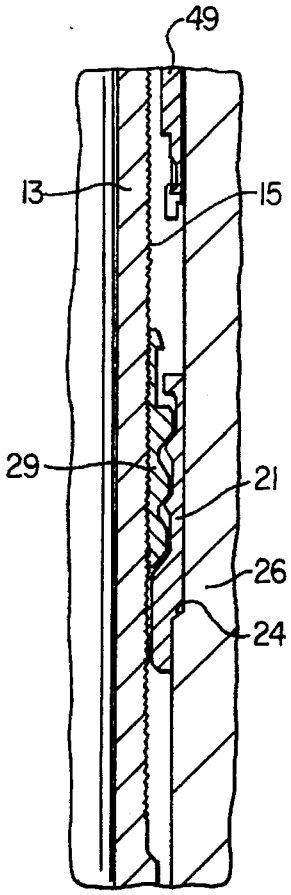

Upward movement of actuator sleeve 49 relative to retainer ring 57 causes retainer ring 57 to expand outward once foot 55 reaches recess 59. Continued upward movement pulls retainer ring 57 above ratchet ring lip 35, as shown in FIG. 6B. Once retainer ring 57 is free of engagement with lip 35, ratchet ring 29 is free to move from the cocked position shown in FIG. 3 to the weight supporting position shown in FIG. 6B. Once tension held by running tool 37 is relaxed, load flanks 25, 33 will contact each other to support casing 11 in tension.

In the operation of the embodiment shown in FIGS. 1–6, locking member 19 will be initially positioned at the lower end of wickers 15 with its lower end engaging mandrel shoulder 17. The operator will support the tieback string 11 at the rig floor, then connect mandrel 13 and running tool 37. The operator will apply hydraulic fluid pressure to the downstroke passage 48, stroking piston 45 and actuator sleeve 49 downward into engagement with locking member 19. Actuator sleeve 49 exerts a downward force on load ring 21 to keep it in engagement with mandrel shoulder 17. As shown in FIG. 3, retainer ring 57 will hold ratchet ring 29 in the cocked position. Foot 55 of actuator sleeve 49 contacts rim 27 of ratchet ring 29 and engages the exterior of retainer ring 57 to keep retainer ring 57 from springing outward.

Figure 4A:
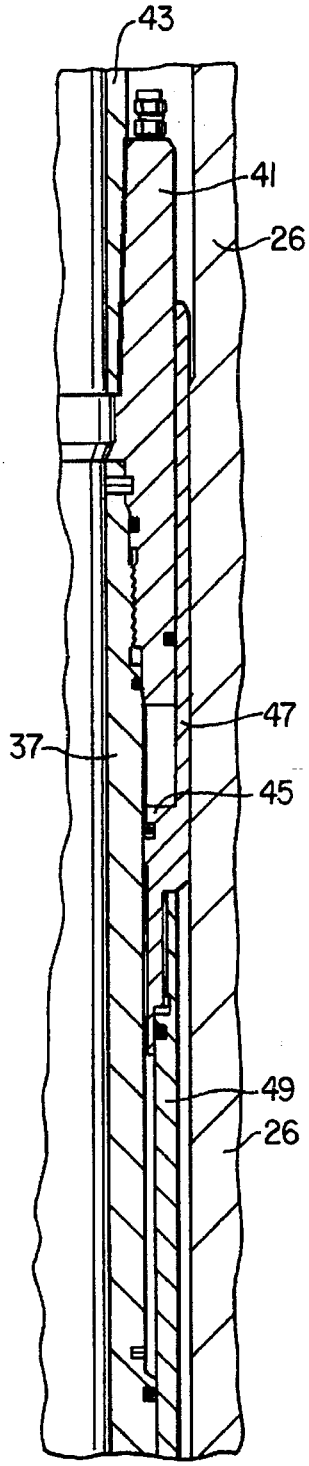
FIGS. 4A and 4B comprise a quarter sectional view of the adjustable mandrel hanger system of FIG. 1 and show the running tool lowering the mandrel relative to the locking member.
Figure 4B:
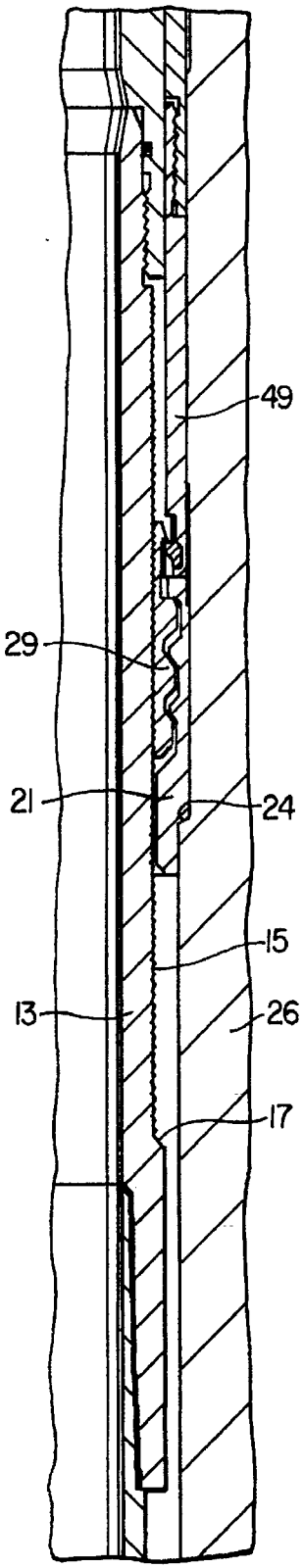

The operator will maintain hydraulic pressure on the upper end piston 45, keeping locking member 19 in the lower position shown in FIG. 1B while he lowers running tool 37 from the rig floor on running string 43 into the surface wellhead housing 26. Once in surface wellhead housing 26, load ring external shoulder 23 will land on wellhead housing internal shoulder 24. The operator then removes the hydraulic pressure on the downstroke passage 48 (FIG. 1A) and lowers the tieback string 11 and mandrel 13 downward a short distance to secure the lower end of string 11 to a tieback latch in the subsea wellhead housing (not shown), which may be hundreds of feet below surface wellhead housing 26. Actuator sleeve 49 maintains ratchet ring 29 in the cocked position while mandrel 13 moves downward. Load ring 21 remains landed on the internal shoulder 24, as shown in FIGS. 4A and 4B. Wickers 15 and 31 will ratchet on one another, and load flanks 25 and 33 will not engage each other during this downward movement of mandrel 13.

Figure 5:
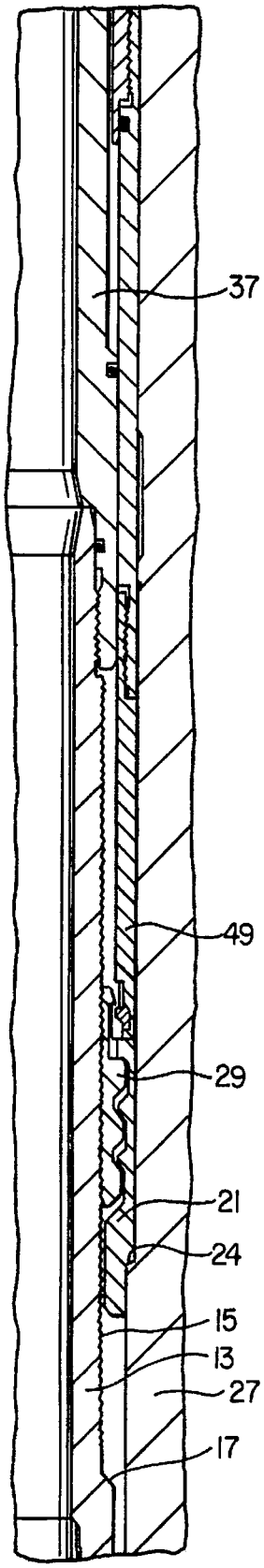
FIG. 5 is a quarter sectional view of the adjustable mandrel hanger system of FIG. 1 and shows tension being pulled on the tieback casing string.

The operator makes the tieback connection in a conventional manner, normally by rotating. Once the tieback connection has been made, the operator again supplies hydraulic pressure to the downstroke passage 48. The operator then begins picking up running string 43 and mandrel 13 to apply tension to the tieback string 11, as shown in FIG. 5. As mandrel 13 moves upward relative to locking member 19, the hydraulic pressure on actuator sleeve 49 keeps load ring 21 from moving upward from internal shoulder 24. Actuator sleeve 49 maintains locking member 19 in the cocked position during this upward movement, and ratchet ring 29 will ratchet on mandrel 13.

Once the approximate amount of tension has been achieved, the operator will cease upward movement of running tool 37 and hold tension in tieback string 11 with the rig elevators. While holding tension, the operator will remove the hydraulic pressure from downstroke passage 48 (FIG. 1) and apply it to upstroke passage 50. As shown in FIGS. 6A and 6B, this causes actuator sleeve 49 to move upward relative to ratchet ring 29. Referring also to FIG. 3, initially foot 55 will move upward relative to retainer ring 57, which will momentarily remain trapped between lip 35 and rim 27. Once foot 55 is adjacent recess 59, the outward-biased retainer ring 57 springs outward. Foot 55 will locate in recess 59 for retrieving retainer ring 57. The operator relaxes the tension, causing load flanks 25 and 33 and wickers 31 and 15 to engage each other. Tension will be retained in casing 11 with the load path passing from mandrel 13 through wickers 15, 31 and through load flanks 25, 33 to surface wellhead housing internal shoulder 24. The operator will then release running tool 37 in a conventional manner from mandrel 13 for retrieval.

Figure 7:
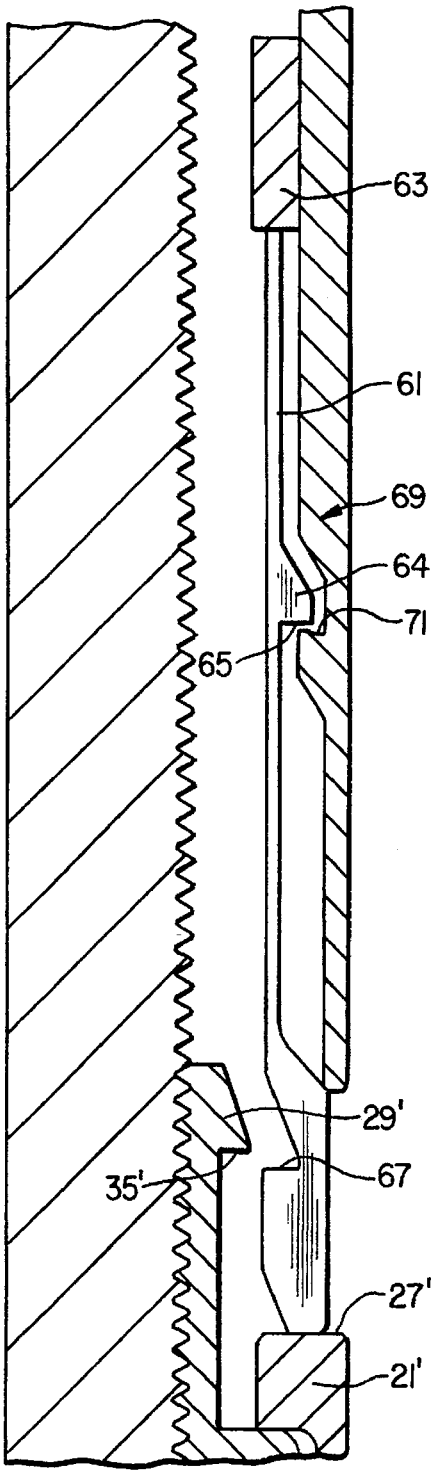
FIG. 7 is a quarter sectional view of an alternate embodiment of a lower portion of the actuating member for the adjustable mandrel hanger system of FIG. 1 and shows the actuating member released from the locking member.
Figure 8:
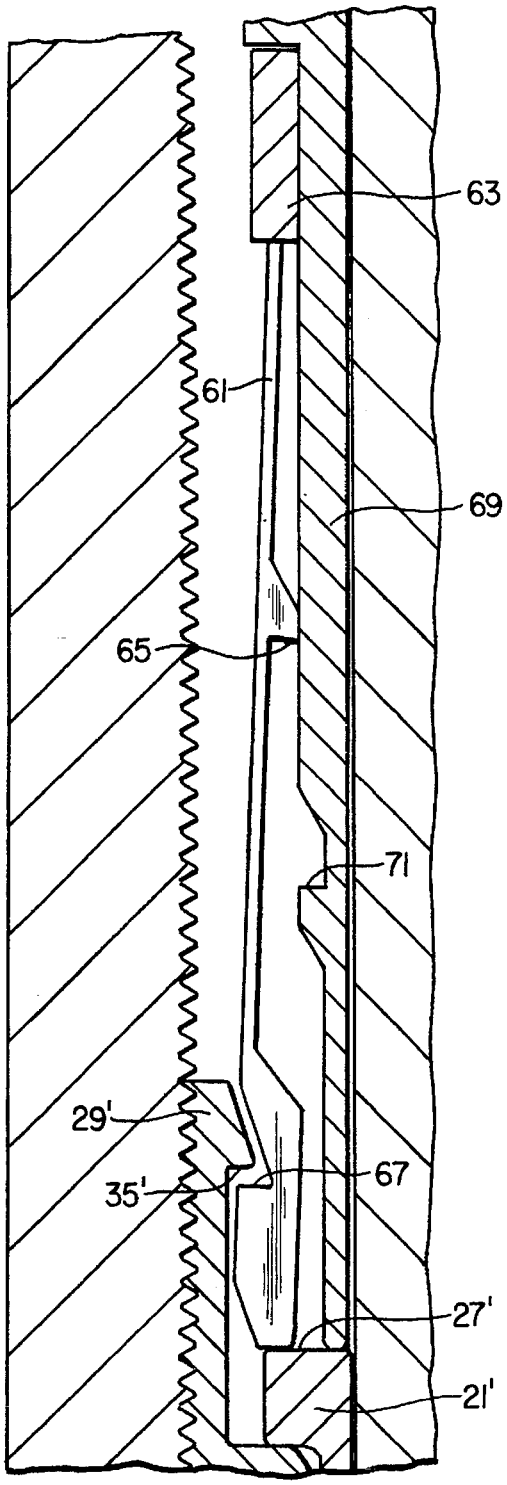
FIG. 8 is a quarter sectional view of the actuating member of FIG. 7 and shows the actuating member in an engaged position with the locking member.

FIGS. 7 and 8 show an alternate embodiment for the actuator sleeve 49 and retainer ring 57. The components of FIGS. 7 and 8 that are the same as in FIGS. 1–6 are indicated by a prime symbol. Retainer ring 57 is replaced by collet fingers 61 which extend downward from a solid ring 63.

Each collet finger 61 has an exterior rib 64 which has a downward facing shoulder 65. At the lower end, each collet finger 61 has an interior recess with an upward facing shoulder 67 for engaging lip 35' of ratchet ring 29'. The lower ends of collet fingers 61 abut rim 27' of load ring 21'.

An actuator sleeve 69 is stroked between upper and lower positions by piston 45 (FIG. 1A) in the same manner as previously described. Actuator sleeve 69 locates on the exterior of collet fingers 61 and has an internal hook-shaped recess 71 for engaging collet finger shoulders 65. The inner diameter of actuator sleeve 69 above recess 71 is smaller than the outer diameter of collet fingers 61 measured at ribs 64.

When piston 45 (FIG. 1A) moves actuator sleeve 69 downward, the inner diameter of actuator sleeve 69 will press inward on ribs 64, deflecting fingers 61 radially inward to the cocked position shown in FIG. 8. In this position, upward facing shoulder 67 will prevent ratchet ring 29' from moving to the weight supporting position shown in FIG. 7. When actuator sleeve 69 is subsequently moved upward, recess 71 will engage shoulders 65, pulling collet fingers 61 upward to free the ratchet ring 29' to move to the weight supporting position.

Referring now to FIGS. 9–12, another embodiment of an adjustable mandrel hanger system is shown. A tieback string of casing 75 is secured at its upper end to a mandrel 77. Mandrel 77 has wickers 79 on its exterior and secures to a running tool 81. A locking member 85 of the same type as locking member 19 (FIG. 1B) engages mandrel 77. Locking member 85 will allow mandrel 77 to move both upward and downward relative to locking member 85 while locking member 85 is in the cocked position. While in the weight supporting position, mandrel 77 will be free to move upward relative to locking member 85, but will not be able to move downward.

Figure 10A:
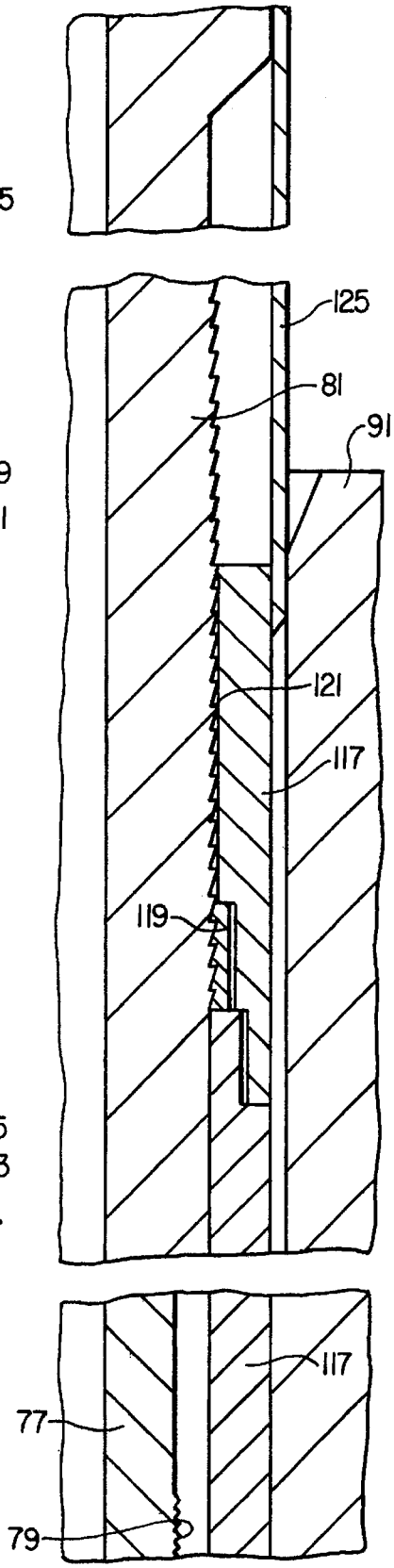
FIGS. 10A and 10B comprise a partial quarter sectional view of the adjustable mandrel hanger system of FIG. 9 and show the system landed in a surface wellhead housing.
Figure 10B:
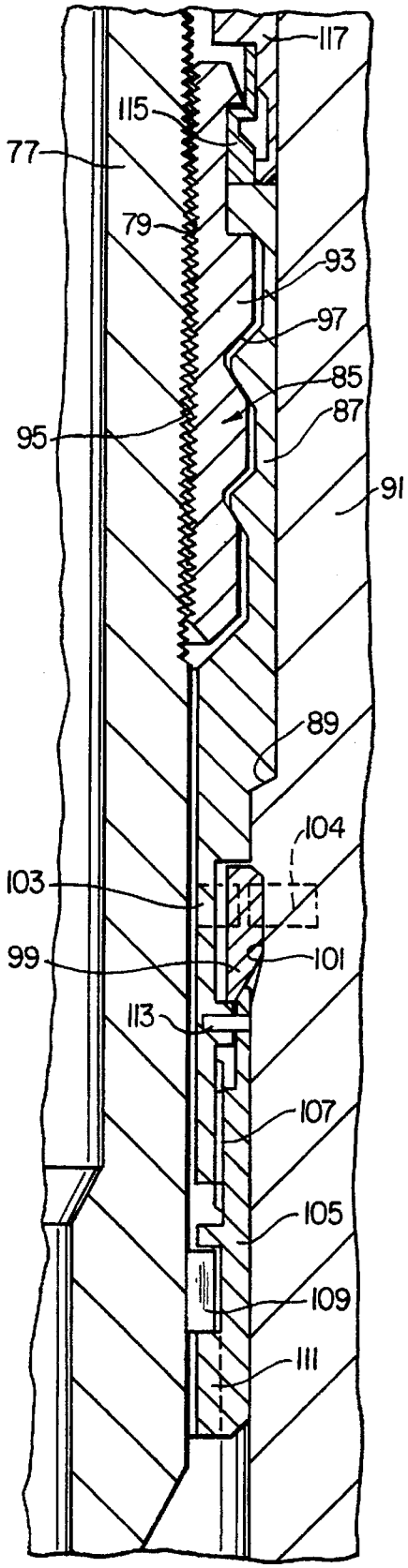

Locking member 85 has a rigid load ring 87 which lands on an internal shoulder 89 within wellhead housing 91 (FIG. 10B). As shown in FIG. 10B, locking member 85 includes a ratchet ring 93 with wickers 95 in its interior for engaging exterior wickers 79 on mandrel 77. Load flanks 97 on ratchet ring 93 and load ring 87 will support tension when allowed to engage.

A retainer ring 99 is located on load ring 87 below where it engages internal shoulder 89. Retainer ring 99 is a split ring which is outward biased to snap into a recess 101 formed in surface wellhead housing 91. An anti-rotation pin 103 extends from load ring 87 into the gap (not shown) of retainer ring 99 to prevent load ring 87 from rotating relative to retainer ring 99. Similarly, an anti-rotation pin 104 mounted in surface wellhead housing 91 extends through recess 101 for engaging the gap of retainer ring 99 to prevent retainer ring 99 from rotating relative to wellhead housing 91. Once engaged, anti-rotation pins 103, 104 prevent rotation of load ring 87 relative to wellhead housing 91.

Figure 11:
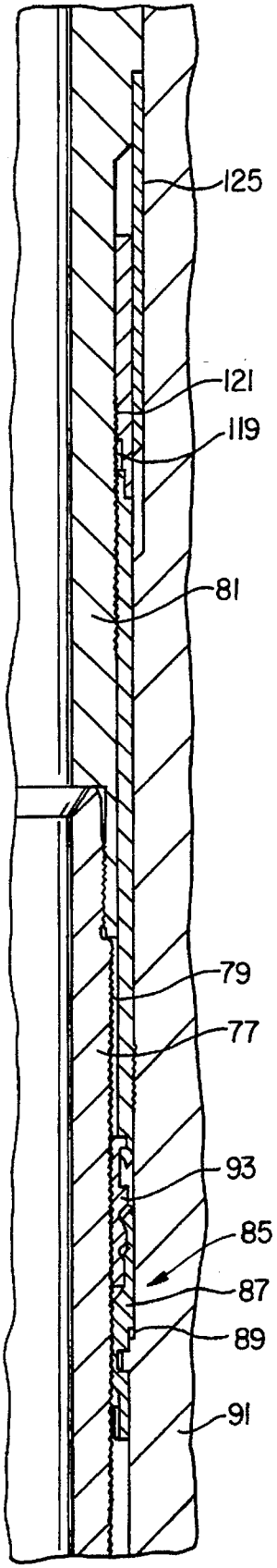
FIG. 11 is a partial quarter sectional view of the adjustable mandrel hanger system of FIG. 9 and shows the tieback string being lowered relative to the locking member.
Figure 12:
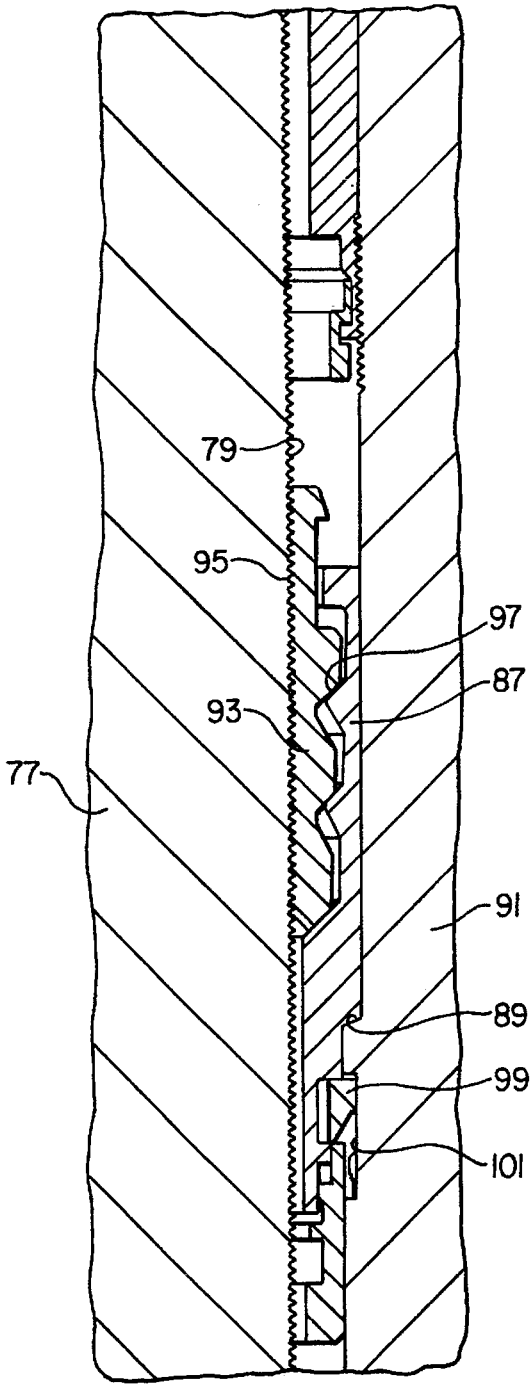
FIG. 12 is a partial quarter sectional view of the adjustable mandrel hanger assembly of FIG. 9 and shows the running tool being released from the locking member.

A J-housing 105 extends downward from load ring 97, being secured by right-hand threads 107 to load ring 87. A J-lug 109 on mandrel 77 releasably locates in a J-slot 111 within J-housing 105. A shear pin 113 prevents rotational movement between J-housing 105 and load ring 87, unless sheared for retrieving load ring 87, as will subsequently be explained. Right-hand rotation of mandrel 77 relative to wellhead housing 91 allows J-lug 109 to move out of J-slot 111. This allows mandrel 77 to move downward relative to load ring 87, as shown in FIG. 11, for making the tieback connection.

Referring to FIG. 10B, a retainer ring 115 holds ratchet ring 93 in the cocked position in the same manner as described in connection with the embodiment of FIGS. 1–6. An actuator sleeve 117, when pulled upward, allows retainer ring 115 to spring outward for retrieval. The upward movement of actuator sleeve 117 also allows ratchet ring 93 to move to the weight supporting position.

Referring to FIG. 10A, after the tieback connection is made, a latch means will cause upward movement of actuator sleeve 117 in response to upward movement of running tool 81. Latch 119 is an inward biased split ring having internal saw-tooth teeth which engage mating teeth 121 on running tool 81. The orientation of teeth 121 allows mandrel 77 to move downward relative to actuator sleeve 117, but not upward. Latch 119 is located within a recess formed in actuator sleeve 117, which is of two pieces secured by threads. A protective sleeve 125 secured to running tool 81 extends downward around an upper portion of actuator sleeve 117.

Figure 9:
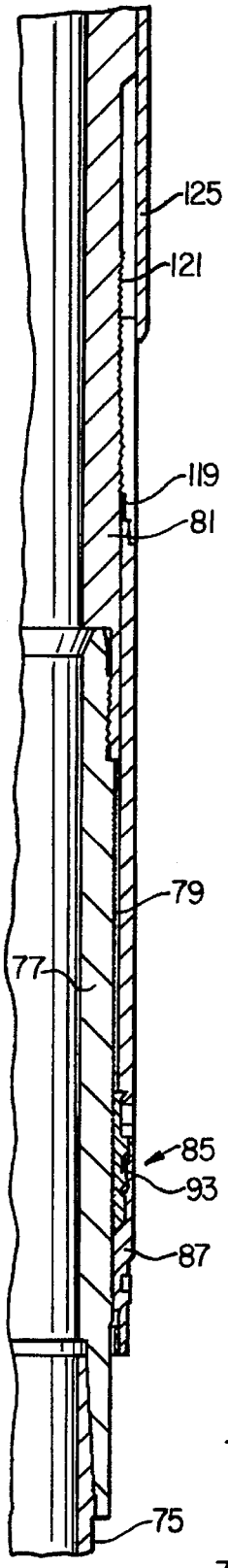
FIG. 9 is a quarter sectional view illustrating another embodiment of an adjustable mandrel hanger system constructed in accordance with this invention.

In the operation of the embodiment of FIGS. 9–12, the assembly will be made up as shown in FIG. 9 and lowered into the surface wellhead housing 91. Actuating sleeve 117 will hold locking member 85 in a lower position as it is being lowered through the blow-out preventer stack. Load ring 87 will land on wellhead housing internal shoulder 87.

Then mandrel 77 will be rotated, causing load ring 87 to rotate until anti-rotation pin 104 enters the gap within retainer ring 99. Retainer ring 99 will spring outward into recess 101, retaining load ring 87 on internal shoulder 89. This rotation of the running tool 81 also allows mandrel 77 to be lowered downward relative to load ring 87 as shown in FIG. 11 due to the disengagement of J-lug 109 from J-slot 111. As mandrel 77 moves downward, ratchet ring 93 will ratchet on wickers 79 because it will be held in the cocked position by retainer ring 115 and actuator sleeve 117. Similarly, teeth 121 will ratchet downward past the teeth of latch 119 (FIG. 10A).

After making the tieback connection, the operator begins to pull upward. Latch 119 (FIG. 10A) will move upward with running tool 81, pulling actuator sleeve 117 upward. Retainer ring 115 (FIG. 10B) springs outward and will move upward relative to load ring 87 with actuator sleeve 117. This frees ratchet ring 93 to move from the cocked position to the weight supporting position. Retaining ring 99 in wellhead housing recess 101 prevents load ring 87 from moving upward with actuator sleeve 117. Once the desired amount of tension has been reached, relaxation of running tool 81 will cause load flanks 97 to engage and wickers 95 and 79 to engage to support the string 75 in tension.

If it is desired to later retrieve load ring 87 from wellhead housing 91, a retrieval tool (not shown) will rotate mandrel 77 to the left. This shears shear pin 113, causing J-housing 105 to rotate upward on threads 107 relative to load ring 87. The upper end of J-housing 105 will force retaining ring 99 to contract and disengage from recess 101.

The invention has significant advantages. In both embodiments, the locking member lands on the internal shoulder during the running-in procedure, and remains on the internal shoulder throughout the tensioning procedure. This feature avoids having to keep the load ring above the landing shoulder while the tieback connection is being made. This feature also avoids having to move the load ring downward onto the internal shoulder while tension is being held on the tieback string. The cocked position prevents the locking member from moving to the weight supporting position until the tieback connection has been made. The system operates either with hydraulic power or with a mechanical latch.

While the invention has been shown in only one of its forms, it should be apparent to those skilled in the art that it is not so limited, but is susceptible to various changes without departing from the scope of the invention.

I claim:

1. An apparatus for supporting in tension a string of casing extending between a subsea wellhead assembly and a surface wellhead housing which has an internal shoulder, comprising:

a mandrel adapted to be connected into the string;

locking means mounted to the mandrel, having a cocked position which allows upward and downward movement of the mandrel between upper and lower positions relative to the locking means, and a weight supporting position which prevents downward movement but allows upward movement of the mandrel relative to the locking means;

an external shoulder on the locking means for landing on the internal shoulder of the surface wellhead housing;

running tool means connected to a running conduit and having a lower end connected to the mandrel for lowering the string through the surface wellhead housing and for landing the external shoulder of the locking means on the internal shoulder while the locking means is in the cocked position and the mandrel in the upper position, the cocked position of the locking means allowing the running conduit to then lower the string and the mandrel relative to the locking means toward the lower position for securing a lower end of the string into engagement with the subsea wellhead assembly;

actuating means on the running tool means having an actuating member for holding the locking means in the cocked position while in engagement with the internal shoulder and while the running conduit is securing the lower end of the string into engagement with the subsea wellhead assembly;

wherein pulling upward on the conduit after the string has been secured to the subsea wellhead assembly applies tension to the string and moves the mandrel toward the upper position; and wherein the actuating member is axially movable relative to the locking means for allowing the locking means to move to the weight supporting position after the string has been secured to the subsea wellhead assembly, so that a release of the pull by the running conduit will cause the locking means to support the string in tension on the internal shoulder.

2. The apparatus according to claim 1, wherein the locking means comprises:

an inner member carried by an outer member on which the external shoulder is formed, the inner member having gripping means for gripping the mandrel when the inner member is allowed to move from the cocked position to the weight supporting position relative to the outer member;

and wherein the actuating means comprises:

retainer means located on a lower end of the actuating member for preventing the inner member from moving to the weight supporting position until the actuating member is moved upward relative to the inner and outer members.

3. The apparatus according to claim 1, wherein the locking means comprises:

an inner member carried by an outer member on which the external shoulder is formed, the inner member having gripping means for gripping the mandrel when the inner member is allowed to move from the cocked position to the weight supporting position relative to the outer member;

and wherein the actuating means comprises:

an outward biased split retainer member carried on a lower end of the actuating member, the retainer member being movable from a cocked position, in engagement with the inner and outer members so as to prevent the inner member from moving to the weight supporting position, to a released position in which it disengages from the inner member; and wherein upward movement of the actuating member relative to the outer member moves the retainer member to the released position.

4. The apparatus according to claim 1, wherein the mandrel has a plurality of grooves on its exterior, and the locking means comprises:

a ratchet ring having an inner diameter containing a set of grooves for mating with the grooves on the mandrel, the ratchet ring having an exterior containing a plurality of inclined load flanks; and a load ring on which the external shoulder is formed, the load ring having an interior containing a plurality of load flanks that mate with the load flanks of the ratchet ring, the ratchet ring being radially expansible so as to radially expand and contract to ratchet on the grooves of the mandrel while in the cocked position, and wherein while in the weight supporting position, the load flanks of the ratchet ring and the load ring support the string on the internal shoulder in tension; and wherein the actuating means comprises:

retainer means located on a lower end of the actuating member for preventing the movement of the ratchet ring from the cocked position to the weight supporting position until the actuating member is moved upward relative to the load ring and ratchet ring.

5. The apparatus according to claim 1, wherein the actuating means moves the actuating member upward relative to the locking member and also relative to the string after the running conduit has pulled tension on the string.

6. The apparatus according to claim 1, wherein the actuating means holds the locking means in engagement with the internal shoulder by applying a downward force through the actuating member to the locking means while the running conduit is pulling tension on the string.

7. The apparatus according to claim 1, wherein the actuating means comprises:

hydraulic means including a piston for applying a downward force on the locking means to maintain the locking means in the cocked position, and for moving the actuating member upward relative to the string and locking means to allow the locking means to move to the weight supporting position.

8. The apparatus according to claim 1, wherein the locking means comprises:

an inner member carried by an outer member on which the external shoulder is formed, the inner member having gripping means for gripping the mandrel when the inner member is allowed to move from the cocked position to the weight supporting position relative to the outer member;

and wherein the actuating means comprises:

hydraulic means including a piston mounted to the actuating member for applying a downward force on the outer member to maintain the outer member on the internal shoulder while in the cocked position, and for moving the actuating member upward relative to the string and outer member to allow the inner member to move to the weight supporting position; and retainer means located on a lower end of the actuating member for preventing the inner member from moving from the cocked position to the weight supporting position until the actuating member is moved upward relative to the inner and outer members.

9. The apparatus according to claim 1, wherein the actuating means moves the actuating member upward with the string and relative to the locking means when the running conduit begins pulling tension on the string.

10. The apparatus according to claim 1, wherein the actuating means comprises:

latch means on the actuating member and running tool means for allowing downward movement of the string relative to the actuating member after the locking means has landed on the internal shoulder, and for moving the actuating member upward relative to the locking means in response to upward movement of the running tool means as the running conduit begins to pull tension.

11. The apparatus according to claim 1, wherein the locking means comprises:

an inner member carried by an outer member on which the external shoulder is formed, the inner member having gripping means for gripping the mandrel when the inner member is allowed to move from the cocked position to the weight supporting position relative to the outer member;

and wherein the actuating means comprises:

latch means on the actuating member and running tool means for allowing downward movement of the string relative to the actuating member after the outer member has landed on the internal shoulder, and for moving the actuating member upward relative to the inner and outer members in response to upward movement of the running tool means as the running conduit begins to pull tension; and retainer means located on a lower end of the actuating member for preventing the inner member from moving from the cocked position to the weight supporting position until the actuating member is moved upward relative to the inner and outer members.

12. An apparatus for supporting in tension a string of casing extending between a subsea wellhead assembly and a surface wellhead housing which has an internal shoulder, comprising:

a mandrel adapted to be connected into the string, the mandrel having exterior grooves;

a ratchet ring having an inner diameter containing a set of grooves for mating with the grooves on the mandrel, the ratchet ring having an exterior containing a plurality of inclined load flanks;

a load ring having an external shoulder and an interior containing a plurality of load flanks that mate with the load flanks of the ratchet ring, the ratchet ring being radially expansible so as to radially expand and contract to ratchet on the grooves of the mandrel, the ratchet ring having a cocked position which prevents the load flanks of the ratchet ring from fully mating with the load flanks of the load ring to allow axial movement of the mandrel relative to the load ring from an upper to a lower position while the ratchet ring is in the cocked position, and wherein while in a weight supporting position, the load flanks of the ratchet ring and the load ring support the string on the internal shoulder in tension;

running tool means having an upper end secured to a running conduit and a lower end secured to the mandrel for lowering the string through the surface wellhead housing and landing the external shoulder of the load ring on the internal shoulder while the ratchet ring is in the cocked position and the mandrel in the upper position, the cocked position of the ratchet ring allowing the running conduit to then lower the string and the mandrel relative to the load ring toward the lower position for securing a lower end of the string into engagement with the subsea wellhead assembly wherein pulling upward with the running conduit after the string is secured to the subsea wellhead assembly applies tension to the string and moves the mandrel upward relative to the ratchet ring toward the upper position;

actuating means including an actuating member carried by the running tool means which has a retainer means for holding the load ring in the cocked position while the string and the mandrel are lowered relative to the load ring, the actuating member being upwardly movable relative to the load ring for allowing the load ring to move to the weight supporting position in response to upward movement of the mandrel, so that a subsequent release of the pull by the running conduit will cause the load ring to support the string in tension on the internal shoulder.

13. The apparatus according to claim 12, wherein the retainer means comprises:

an outward biased split retainer member carried on a lower end of the actuating member, the retainer member being movable from a locked position, in engagement with the ratchet ring and load ring so as to prevent the ratchet ring from moving to the weight supporting position, to a released position in which it disengages from the ratchet ring; and wherein upward movement of the actuating member relative to the load ring moves the retainer member to the released position.

14. The apparatus according to claim 12, wherein the actuating means moves the actuating member upward relative to the load ring and also relative to the string after the running conduit has pulled tension on the string.

15. The apparatus according to claim 12, wherein the actuating means holds the load ring in engagement with the internal shoulder by applying a downward force through the actuating member to the load ring while the running conduit is pulling tension on the string.

16. The apparatus according to claim 12, wherein the actuating means comprises:

hydraulic means including a piston mounted to the actuating member for applying a downward force on the load ring to maintain the load ring on the internal shoulder in the cocked position, and for moving the actuating member upward relative to the string and the load ring after the running conduit has applied tension to the string to allow the ratchet ring to move to the weight supporting position.

17. The apparatus according to claim 12, wherein the actuating means moves the actuating member upward with the mandrel relative to the load ring in unison with the mandrel as the running conduit begins pulling tension on the string.

18. The apparatus according to claim 12, wherein the actuating means comprises:

latch means on the actuating member and running tool means for allowing downward movement of the string relative to the actuating member after the load ring has landed on the internal shoulder, and for moving the actuating member upward relative to the load ring in unison with the upward movement of the mandrel as the running conduit begins to pull tension.

19. An apparatus for supporting in tension a string of casing extending between a subsea wellhead assembly and a surface wellhead housing which has an internal shoulder, comprising:

a mandrel adapted to be connected into the string, the mandrel having exterior grooves;

a ratchet ring having an inner diameter containing a set of grooves for mating with the grooves on the mandrel, the ratchet ring having an exterior containing a plurality of inclined load flanks;

a load ring having an external shoulder and an interior containing a plurality of load flanks that mate with the load flanks of the ratchet ring, the ratchet ring being radially expansible so as to radially expand and contract to ratchet on the grooves of the mandrel, the ratchet ring having a cocked position which prevents the load flanks of the ratchet ring from fully mating with the load flanks of the load ring to allow axial movement of the mandrel relative to the load ring from an upper to a lower position while the ratchet ring is in the cocked position, and wherein while in a weight supporting position, the load flanks of the ratchet ring and the load ring support the string on the internal shoulder in tension;

running tool means having an upper end connected to a running conduit and a lower end connected to the mandrel for lowering the string through the surface wellhead housing and landing the external shoulder of the load ring on the internal shoulder while the ratchet ring is in the cocked position and the mandrel in the upper position, the cocked position of the ratchet ring allowing the running conduit to lower the string relative to the load ring for securing a lower end of the string into engagement with the subsea wellhead assembly;

wherein an upward pull by the running conduit after the string is secured to the subsea wellhead assembly moves the mandrel upward and applies tension to the string;

an actuating member carried by the running tool means;

hydraulic means including a piston mounted to the actuating member for moving the actuating member between a lower position in engagement with the load ring and an upper position above the load ring and ratchet ring;

an outward biased split retainer member carried on a lower end of the actuating member, the retainer member being movable from a locked position, in engagement with the ratchet ring and load ring so as to prevent the ratchet ring from moving to the weight supporting position while the running conduit lowers the string relative to the load ring, to a released position in which it disengages from the ratchet ring after the running conduit pulls a selected amount of tension on the string; and wherein upward movement by the hydraulic means of the actuating member relative to the load ring moves the retainer member to the released position.

20. The apparatus according to claim 19 wherein the retainer member has a downward facing shoulder and wherein the apparatus further comprises:

an upward facing shoulder on the actuating member for engaging the downward facing shoulder on the retainer member to withdraw the retainer member from engagement with the ratchet ring and load ring while the hydraulic means moves the actuating member to the upper position.

21. The apparatus according to claim 19 wherein the retainer member has a downward facing shoulder and wherein the apparatus further comprises:

wedge means for pushing the retainer member radially inward into engagement with the ratchet ring when the actuating member is moved to the lower position; and an upward facing shoulder on the actuating member for engaging the downward facing shoulder on the retainer member to withdraw the retainer member from engagement with the ratchet ring and load ring while the hydraulic means moves the actuating member to the upper position.

22. A method for supporting in tension a string of casing extending between a subsea wellhead assembly and a surface wellhead housing which has an internal shoulder, comprising:

connecting a mandrel into the string;

mounting a locking member to the mandrel which has a cocked position which allows upward and downward movement of the mandrel relative to the locking member and a weight supporting position which prevents downward movement but allows upward movement of the mandrel relative to the locking member;

lowering the string through the surface wellhead housing and landing the locking member on the internal shoulder; then while maintaining the locking member in the cocked position on the internal shoulder, lowering the string and securing a lower end of the string into engagement with the subsea wellhead assembly; then pulling tension on the string; and moving the locking member to the weight supporting position, and releasing the pull on the string, causing the locking member to support the string in tension on the internal shoulder.

23. The method according to claim 22, wherein the locking member is maintained in the cocked position until a selected amount of tension has been pulled on the string.

24. The method according to claim 22, wherein the locking member is released to the weight supporting position in response to upward movement of the string when pulling tension.

* * * * *